US005827097A

United States Patent [19]

Ando

[11] Patent Number: 5,827,097

[45] Date of Patent: Oct. 27, 1998

[54] OARLOCK

[76] Inventor: Kunio Ando, 3-39-34 Kita, Kunitachi-shi, Tokyo, Japan

[21] Appl. No.: 967,897

[22] Filed: Nov. 12, 1997

[51] Int. Cl.[6] ..... B63H 16/06

[52] U.S. Cl. ..... 440/106

[58] Field of Search ..... 440/104–110; 416/74; D12/215

[56] References Cited

U.S. PATENT DOCUMENTS 4,941,855 7/1990 Agner .

*Primary Examiner*—Ed L. Swinehart
*Attorney, Agent, or Firm*—Kanesaka & Takeuchi

[57] ABSTRACT

An oarlock of the invention is attached to a boat for supporting an oar. The oarlock is basically formed of an oar supporting member, a pivot part, and a bolt for assembling the oar supporting member and the pivot part. The oar supporting member is formed of one clamping plate which is shaped into a cylindrical oar holder part and a rectangular lower part with a rectangular opening at the bottom thereof. The pivot part is formed of a top portion with a through hole and a pin. When the oar supporting member and the pivot part are assembled, the bolt is inserted into through holes of the oar supporting member and a through hole of the pivot part. When the oar held in the oar supporting member is moved up or down, one of the side edges of the top portion hits a corresponding edge of the rectangular opening, so that the pivotal movement of the oar can be desirably restricted within a certain range.

4 Claims, 5 Drawing Sheets

FIG. 4
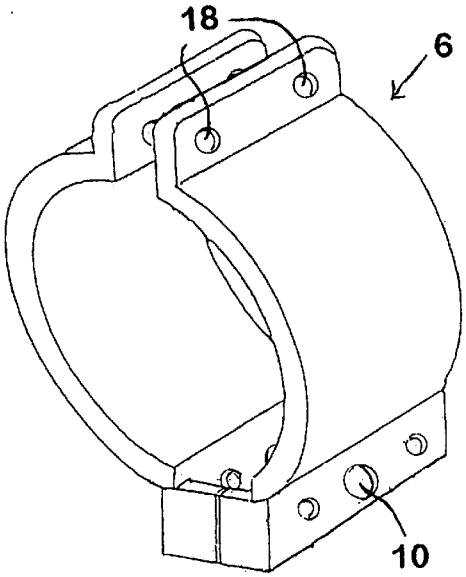
FIG. 5
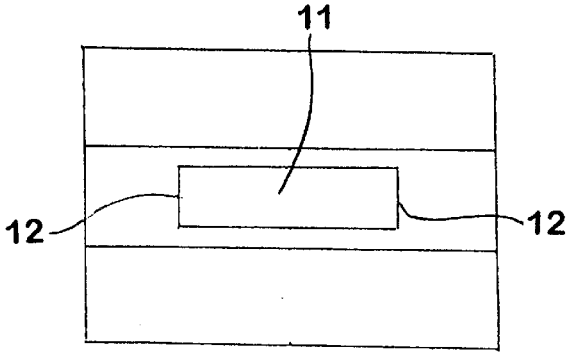
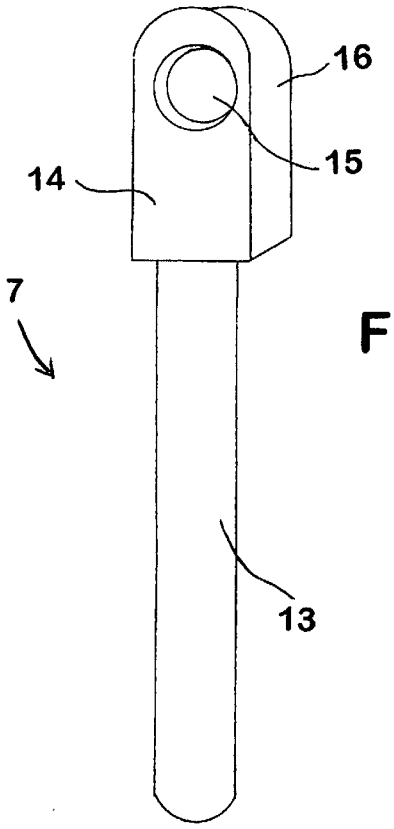
FIG. 6

OARLOCK

BACKGROUND OF THE INVENTION AND RELATED ART STATEMENT

The present invention relates to an oarlock, and particularly to an oarlock wherein an oar supporting part is formed of one clamping member, and a structure thereof is greatly simplified.

An oarlock, as known in the art, is a device formed of a clamping member and a pin attached to the clamping member for such pivotal movement of an oar. When the oar is used, the oar should not move either too high or too low so as to paddle effectively. In order to limit pivotal movement of the oar, various structures of the oarlocks have been invented.

For example, as disclosed in U.S. Pat. No. 4,941,855, an oarlock is formed of an oar supporting or clamping member and a pin. The oar clamping member is formed of a pair of clamping plates with opposite arcuate portions to define a holder part of the oar. The pin is attached to the bottom of the clamping member by bolt and nut assemblies, and the pin is provided with an annular shoulder. The clamping member has a periphery with portions which engage an upper surface of the annular shoulder of the pin in response to pivotal movement of the clamping member holding the oar. Namely, the portions engaging the upper surface of the annular shoulder respectively extend at an angle of 45° relative to a central portion which extends horizontally. Therefore, when the oar is paddled, one of the portions, i.e. side portions, engages the upper surface of the annular shoulder so that the oar does not move either beyond a certain high point or below a certain low point in the water. Further, since the clamping member is formed of a pair of the clamping plates, additional bolt and nut assemblies are provided to clamp the plates.

In the conventional oarlock, however, there was the following problem. Since the additional bolt and nut assemblies are provided to fasten the clamping plates, the clamping member is too tightly attached to the pin. This configuration prevents or hinders the pivotal movement of the clamping member holding the oar.

Also, in the conventional oarlock, in order to limit the pivotal movement of the oar within a certain range, a stopper member, such as the annular shoulder attached to the pin, is required, and the respective lower end of the clamping plate is required to have a shape with bias-cut side portions for engaging the upper surface of the annular shoulder. Therefore, the overall structure of the conventional oarlock is quite complicated, and requires many parts.

Accordingly, one object of the invention is to provide an oarlock which does not require additional nut and bolt assemblies so as not to prevent or hinder movement of the oar supporting member.

Another object of the invention is to provide an oarlock which is simple in design and configuration.

Further objects and advantages of the invention will be apparent from the following description of the invention.

SUMMARY OF THE INVENTION

To achieve the aforementioned objects, the invention provides an oarlock used for holding an oar to row a boat, including: an oar supporting member formed of one clamping plate shaped into a cylindrical oar holder part and a rectangular lower part; a pivot part formed of a top portion and a pivot; and a bolt for attaching the oar supporting member and the pivot part together. The rectangular lower part includes a bottom with a rectangular opening, and side walls provided with through-holes near the bottom. The rectangular opening defines edges therearound in the bottom of the rectangular lower part. The top portion of the pivot part, having a through hole, passes through the rectangular opening when the oar supporting member and the pivot part are assembled. Then, the bolt passes through the through-holes of the oar supporting member and the through hole of the pivot part. The top portion has side edges hitting the edges around the rectangular opening when the oar held in the oar supporting member is moved in the predetermined angle.

Also, open upper end portions of the oar holder part can be provided with at least one bolt for retaining the oar in the oar holder part. Since the bolt is provided in the open upper end portions away from the bolt for an axis of the pivotal movement, it does not prevent the pivotal movement of the oar supporting member.

Furthermore, the oarlock can be attached to a boat through a socket having a cylindrical shape. The socket with a cylindrical hole therein is preliminarily fixed in a gunwale of the boat. When the pivot of the oarlock is inserted into the cylindrical hole, the oarlock can be attached to the boat.

Preferably, the aforementioned predetermined angle with respect to a horizontal axis is approximately 35°.

Since the oar supporting member is formed of only one clamping plate, the additional bolt is no longer required to clamp or fasten the oar supporting member. In addition, since the structure for restricting movement of the oar within a certain range can be simply achieved by assembling the oar supporting member having the rectangular opening at the bottom thereof and the pivot part having the top portion passing through the rectangular opening, the structure of the oar supporting member is greatly simplified. Therefore, according to the invention, manufacturing cost for the oar supporting member can be reduced.

BRIEF DESCRIPTION OF THE DRAWINGS

FIG. 1(*b*) is an explanatory view showing an attachment of the oarlock;

FIG. 4 is a perspective view of an oar support part of the oarlock;

FIG. 5 is a bottom plan view of the oar support part shown in FIG. 4;

FIG. 6 is a pivot part of the oarlock;

DETAILED DESCRIPTION OF PREFERRED EMBODIMENTS

An embodiment of the present invention will be explained with reference to the drawings attached herewith.

Figure 1A:
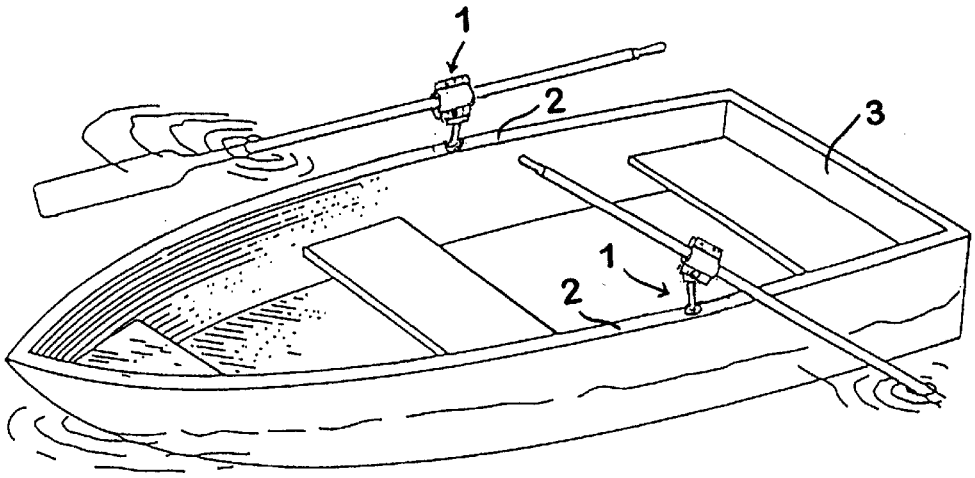
FIG. 1(*a*) is an explanatory view of an oarlock attached to a boat.
Figure 1B:
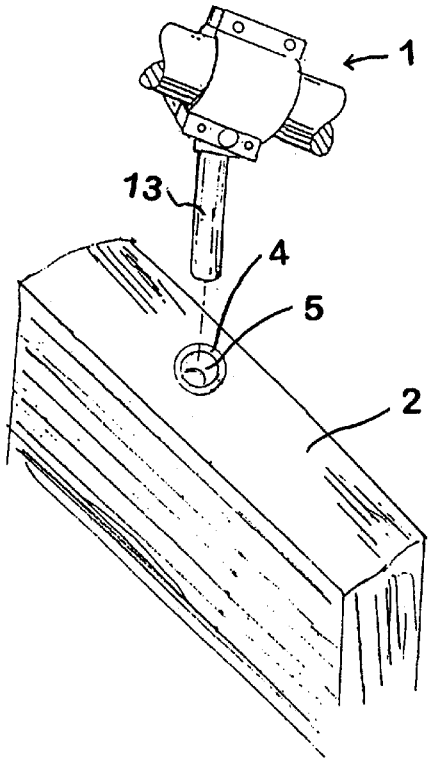
Figure 2:
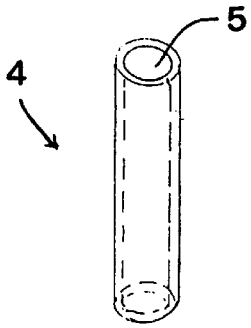
FIG. 2 is a perspective view of a socket for attaching the oarlock to the boat.

As shown in FIGS. 1(*a*) and 1(*b*), an oarlock 1 of the invention is attached to a gunwale 2 of a boat 3 through a socket 4 embedded in the gunwale 2. The socket 4 has, for example, a cylindrical shape as shown in FIG. 2, and has a cylindrical attachment hole 5 therein. The socket 4 is securely fixed in the gunwale 2, and a pivot 13 of the oarlock 1 is introduced into the attachment hole 5 of the socket 4 to attach the oarlock 1 to the boat 3.

Figure 3:
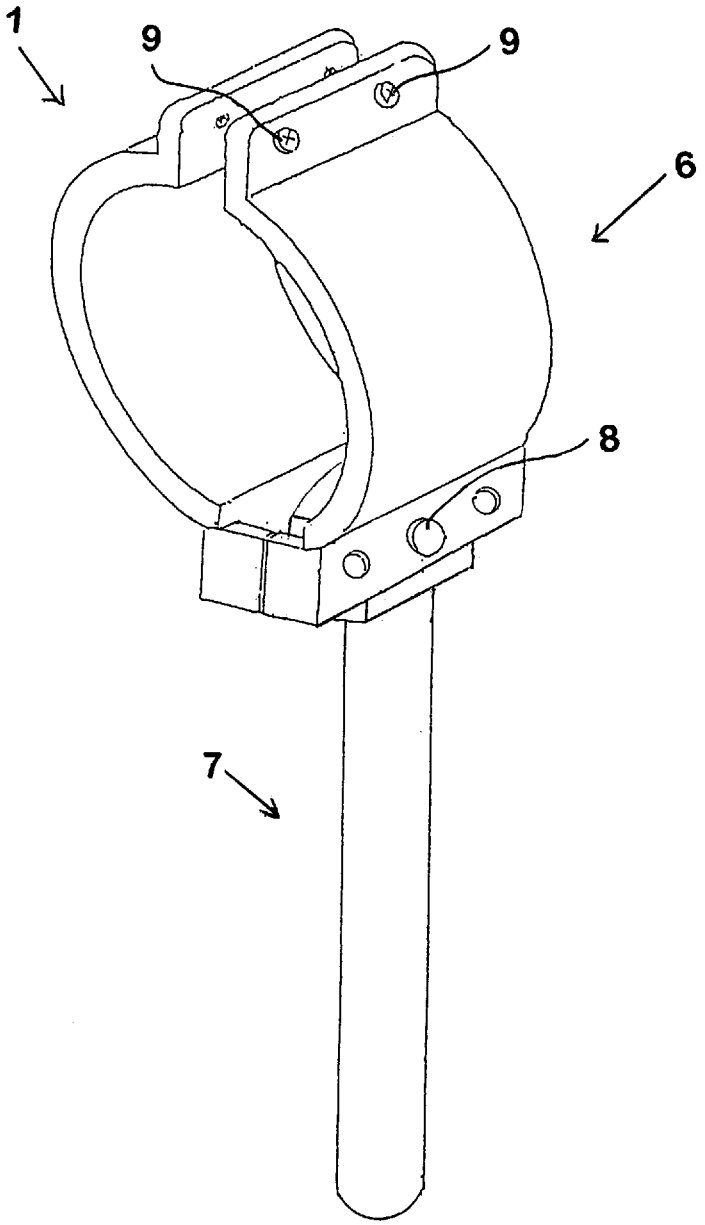
FIG. 3 is a perspective view of the oarlock according to an embodiment of the invention.
Figure 7:
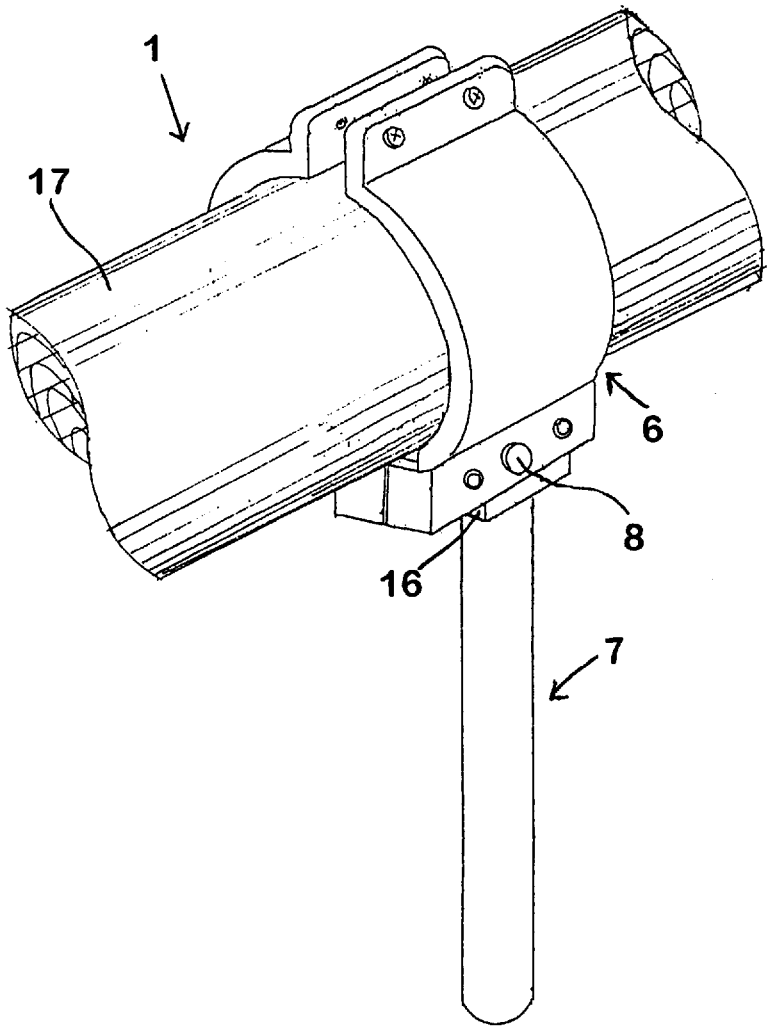
FIG. 7 is a perspective view of the oarlock holding an oar.

The oarlock 1 is formed of an oar supporting part 6 and the pivot part 7, as shown in FIG. 3. The pivot part 7 is attached to the oar supporting part 6 by a bolt 8.

As shown in FIGS. 4 and 5, the oar supporting part 6 is formed of one sheet of clamping plate having a shape of a combination of a cylindrical oar support and a rectangular bottom. An upper portion of the oar supporting part 6, i.e. open ends of the clamping plate, has holes 18, and bolts 9 are inserted into the holes 18 in order to keep an oar 17 in the oar supporting part 6. The bottom of the oar supporting part 6 has a rectangular opening 11 for inserting a top portion 14 of the pivot part 7 therethrough. Near the bottom of the side walls of the oar supporting part 6, there are formed holes 10 for inserting the bolt 8 therethrough. Although the oar supporting part 6 shown in the figures includes holes for inserting additional bolts adjacent to the hole 10, alternatively, only holes 10 for inserting the bolt 8 can be provided at the lower end of the oar supporting part 6.

FIG. 6 shows a perspective view of the pivot part 7. The pivot part 7 is formed of the top portion 14 and the pivot 13. The top portion 14 has a hole 15, and when the oar supporting part 6 and the pivot part 7 are assembled, the bolt 8 passes through the hole 10 on one side wall, into the hole 15, and exits through the hole 10 on the other side wall. When the oar 17 held in the oar supporting part 6 is moved, the oar supporting part 6 pivots around the bolt 8.

When the oarlock 1 is assembled as described above and the oar 17 is placed in the oar supporting part 6, the oar 17 can be pivotally moved in the range defined by a size of the rectangular opening 11 and a size of the top portion 14, or a ratio thereof.

Figure 8:
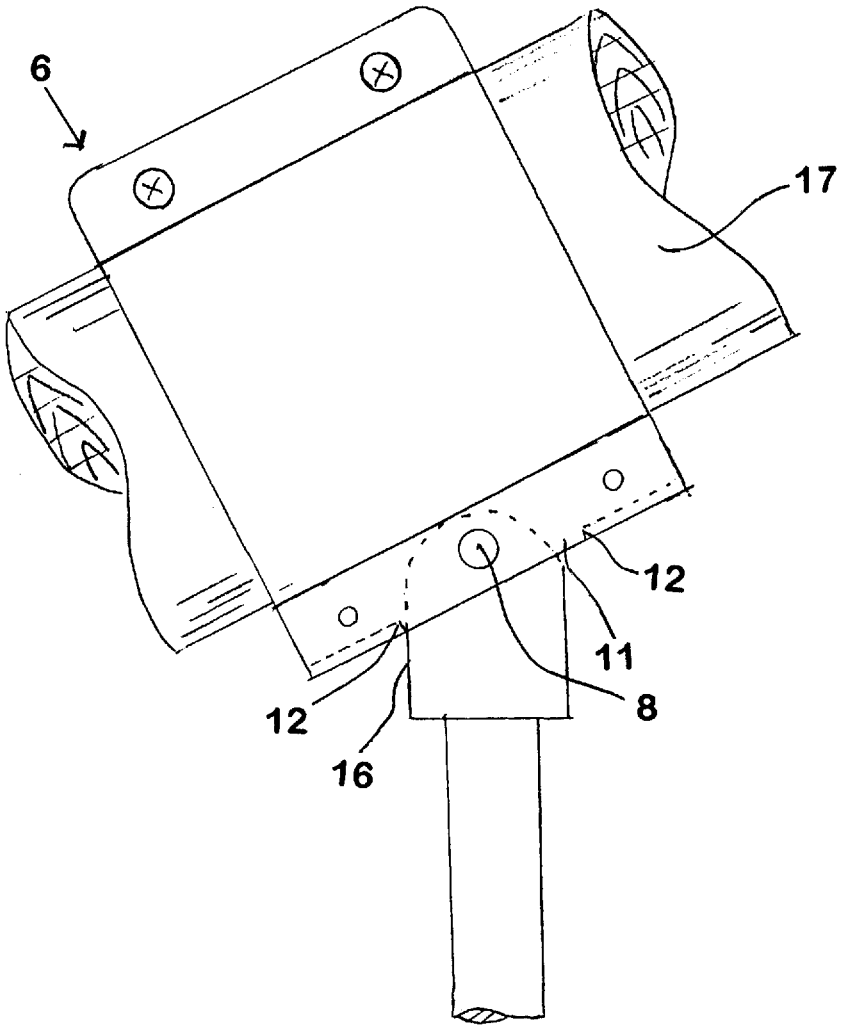
FIG. 8 is a schematic view showing a part of the oarlock which is in use.

Namely, as shown in FIG. 8, when the oar 17 is moved in one direction, side portions 16 of the top portion 14 hit the corresponding side portions 12 around the rectangular opening 11 of the bottom of the oar supporting part 6, so as to stop the oar 17 at a certain angle. Preferably, the aforementioned sizes are designed such that an angle of incline for the oar with respect to the horizontal line is approximately 35°, which is considered to be an appropriate angle for paddling effectively.

According to the present invention, since the oar supporting part is formed of only one clamping plate, there is no need to clamp the supporting part with an additional clamping bolt, other than the bolt for pivotal movement. Therefore, there is no problem of the pivotal movement of the oar supporting member being prevented or hindered by clamping force exerted by the additional bolt. The overall design and configuration of the oarlock of the present invention are advantages in that the total number of parts required to constitute the oar supporting member is reduced in comparison with the conventional oarlock or the like.

Further, the pivot part or pin of the present invention includes a top portion and a pivot, and side portions of the top portion hit the respective edges of the rectangular opening formed in the bottom of the oar supporting member. Therefore, pivotal movement of the oar can be restricted within a certain preferred range when the oar is paddled. Therefore, an annular shoulder, which is required to be attached to the upper portion of the pin of the conventional oarlock, is no longer needed. Accordingly, assembly and structure of the oarlock can be simplified in the present invention, resulting in lower manufacturing cost for the oarlock.

While the invention has been explained with reference to the specific embodiments of the invention, the explanation is illustrative and the invention is limited only by the appended claims.

What is claimed is:

1. An oarlock used for holding an oar to row a boat, comprising:

an oar supporting member formed of one clamping plate shaped into a cylindrical oar holder part and a rectangular lower part, said rectangular lower part having a bottom with a rectangular opening, and side walls facing each other, each of said side walls having a through-hole, said rectangular opening defining edges therearound in the bottom of the rectangular lower part, a pivot part formed of a top portion and a pivot, said top portion having a through hole and passing through said rectangular opening when the oar supporting member and the pivot part are assembled, and a bolt for attaching the oar supporting member and the pivot part together and passing through the through-holes of the oar supporting member and the through hole of the pivot part, said oar supporting member being pivotally movable about an axis of the bolt, said top portion having side edges hitting the respective edges of the rectangular opening when the oar held in the oar supporting member is moved within a predetermined angle with respect to a horizontal axis of the boat.

2. An oarlock according to claim 1, wherein the cylindrical oar holder part has open upper end portions, said open upper end portions being clamped by at least one bolt for retaining the oar in the oar holder part.

3. An oarlock according to claim 2, wherein said oarlock is attached to a boat through a socket having a cylindrical shape, said socket being fixed in a gunwale of the boat and having a cylindrical hole, said pivot of the oarlock being inserted into the cylindrical hole so as to attach the oarlock to the boat.

4. An oarlock according to claim 1, wherein the predetermined angle is approximately 35°.

* * * * *